US011555260B2

(12) United States Patent
Tsukamoto et al.

(10) Patent No.: US 11,555,260 B2
(45) Date of Patent: Jan. 17, 2023

(54) APPARATUS FOR MANUFACTURING OPEN CARBON FIBER SUPERFINE YARN

(71) Applicant: Japan Matex Co. Ltd., Sennan (JP)

(72) Inventors: Katsuro Tsukamoto, Sennan (JP); Hiroaki Tsukamoto, Sennan (JP)

(73) Assignee: Japan Matex Co. Ltd., Sennan (JP)

( * ) Notice: Subject to any disclaimer, the term of this patent is extended or adjusted under 35 U.S.C. 154(b) by 3 days.

(21) Appl. No.: 17/341,938

(22) Filed: Jun. 8, 2021

(65) Prior Publication Data

US 2021/0292935 A1 Sep. 23, 2021

Related U.S. Application Data

(63) Continuation of application No. 16/213,157, filed on Dec. 7, 2018, now Pat. No. 11,131,041.

(30) Foreign Application Priority Data

Jan. 31, 2018 (JP) ..... 2018-016013

(51) Int. Cl.

| | |
|---|---|
| ***D02G 3/06*** | (2006.01) |
| ***D02J 3/02*** | (2006.01) |
| ***D02J 1/18*** | (2006.01) |
| ***D02J 11/00*** | (2006.01) |

(52) U.S. Cl.

CPC ..... *D02G 3/06* (2013.01); *D02J 1/18* (2013.01); *D02J 3/02* (2013.01); *D02J 11/00* (2013.01); *D10B 2101/12* (2013.01)

(58) Field of Classification Search

CPC ..... D02G 3/06; D02J 1/18; D02J 3/02; D02J 11/00; D06B 21/00; D06B 23/023

See application file for complete search history.

(56) References Cited

U.S. PATENT DOCUMENTS

| | | | | | |
|---|---|---|---|---|---|
| 2,403,317 | A | * | 7/1946 | Warren, Jr. | D02G 3/08 57/260 |
| 3,328,850 | A | * | 7/1967 | Watson | D04H 3/00 28/282 |
| 3,398,220 | A | * | 8/1968 | Port | D01D 5/423 264/168 |
| 3,417,560 | A | * | 12/1968 | Watson | D02G 3/06 19/66 T |
| 3,664,115 | A | * | 5/1972 | Watson | D02J 1/18 57/31 |
| 3,669,158 | A | * | 6/1972 | Phillips | D03D 15/267 139/420 C |

(Continued)

*Primary Examiner* — Shaun R Hurley

(74) *Attorney, Agent, or Firm* — George McGuire

(57) ABSTRACT

An apparatus for manufacturing open carbon fiber superfine yarn comprises a yarn feeding part for feeding a carbon fiber bundle; a tank for storing water for opening carbon fiber to immerse the carbon fiber bundle in the water for opening carbon fiber; a first drying part for drying the open carbon fiber bundle formed by the immersion in the water for opening carbon fiber; an application part for applying a catalyst to the dried open carbon fiber bundle; a second drying part for drying the catalyst-applied open carbon fiber bundle to obtain open carbon fiber resin tape; a slitting part for slitting the open carbon fiber resin tape longitudinally; and a twisting part for twisting a plurality of the open carbon fiber resin tapes slit by the slitting part to form open carbon fiber superfine yarn.

2 Claims, 12 Drawing Sheets

(56) References Cited

U.S. PATENT DOCUMENTS

| | | | | | |
|---|---|---|---|---|---|
| 3,715,878 | A * | 2/1973 | Kim | D02G 3/42 | 57/24 |
| 3,796,035 | A * | 3/1974 | Watson | D02G 1/18 | 57/239 |
| 4,014,973 | A * | 3/1977 | Thompson | A61L 17/14 | 606/228 |
| 4,532,169 | A * | 7/1985 | Carley | B29C 70/083 | 264/108 |
| 5,126,191 | A * | 6/1992 | Fourezon | D06C 11/00 | 428/96 |
| 5,165,993 | A * | 11/1992 | van Anholt | D06M 15/256 | 28/165 |
| 7,807,590 | B2 * | 10/2010 | Takeuchi | D03D 15/68 | 428/394 |
| 10,682,668 | B2 * | 6/2020 | Tsukamoto | C08K 3/22 | |
| 10,844,523 | B2 * | 11/2020 | Tsukamoto | D02G 3/06 | |
| 11,131,041 | B2 * | 9/2021 | Tsukamoto | D02G 3/06 | |
| 2004/0043213 | A1 * | 3/2004 | Tonon | B65H 57/16 | 28/282 |
| 2015/0152593 | A1 * | 6/2015 | Darda | D07B 1/025 | 87/8 |
| 2017/0233611 | A1 * | 8/2017 | Tsukamoto | D06M 11/50 | 428/299.1 |
| 2018/0056325 | A1 * | 3/2018 | Tsukamoto | B05D 1/18 | |
| 2019/0232529 | A1 * | 8/2019 | Torres Martinez | B60N 2/2872 | |

* cited by examiner

APPARATUS FOR MANUFACTURING OPEN CARBON FIBER SUPERFINE YARN

CROSS-REFERENCE TO RELATED APPLICATION

This application is a continuation of U.S. application Ser. No. 16/213,157, filed Dec. 7, 2018, now allowed, which claims priority to Japanese patent application no. JP2018-016013, filed on Jan. 31, 2018 and entitled "Apparatus for manufacturing open carbon fiber superfine yarn," the entire disclosure of each of which is incorporated herein by reference.

FIELD OF THE INVENTION

The present invention relates to an apparatus for manufacturing open carbon fiber superfine yarn. More specifically, the present invention relates to an apparatus for manufacturing open carbon fiber superfine yarn with a wet-type opening method.

BACKGROUND

Carbon fiber has a lower density and a high elasticity modulus. For example, carbon fiber resin tape and carbon fiber superfine yarn obtained by impregnating carbon fiber with synthetic resin (FRP etc.) have been widely used for various applications such as electric and electronic purposes, houses, engineering and construction, automobiles, airplanes, marine vessels, clothes, or the like.

While carbon fiber is usually present in a bundled state (fiber bundle), the carbon fiber bundle is generally opened thinly and widely in a width direction to improve impregnation property to synthetic resin in order to produce open carbon fiber.

A dry-type air opening method (see Japanese Patent No. 3049225), a dry-type laser opening method, or a wet-type opening method has been traditionally used as a method for producing open carbon fiber and carbon fiber superfine yarn.

The inventors have proposed a wet-type opening method using low potential water, instead of the above-described dry-type opening method, as a method of producing open carbon fiber and open carbon fiber superfine yarn (see Japanese Patent No. 6041416).

This wet-type opening method has been currently used for a 3 k-24 k regular bundle (regular tow) (i.e., 7 micrometers in diameter.times.3000 to 7 micrometers in diameter.times.24000) and a large bundle of more than 24 k (large tow) (i.e., more than 7 micrometers in diameter.times.24000 to 7 micrometers in diameter.times.64000) as carbon fiber raw yarn. The carbon fiber raw yarn is impregnated with synthetic resin (FRP etc.) (prepreg) to manufacture open carbon fiber resin tape.

Moreover, the open carbon fiber resin tape is slit into any K such as 1 K (7 micrometers in diameter.times.1000) by a continuous slitting machine, and the slit open carbon fiber resin tape is then twisted by a twister to manufacture open carbon fiber superfine yarn (for example, 0.15-0.35 mm in diameter).

Recently, the open carbon fiber resin tape and the open carbon fiber superfine yarn have been broadly used for various applications such as electric and electronic purposes, houses, engineering and construction, automobiles, airplanes, marine vessels, clothes, or the like.

SUMMARY

The traditional dry-type opening method could scatter superfine fiber waste with a very small diameter in the air in the process of producing open carbon fiber.

The superfine fiber waste could have an adverse effect on a human body and thus the space for producing the open carbon fiber needs to be isolated.

Accordingly, the dry-type opening method had some problems, i.e., environmental concerns and complicated production facilities.

In addition, the method had a drawback that the continuous slitting traditionally required for opening could not be uniformly and precisely performed at equal intervals.

The inventors employed a wet-type opening method and succeeded in preventing the superfine fiber waste with a very small diameter from scattering in the air in the process of producing open carbon fiber.

Accordingly, the superfine fiber waste with a very small diameter does not scatter in the air in the process of producing open carbon fiber, which led to simplification of the production facility without the need of isolating the space for producing the open carbon fiber.

Further, they found an apparatus that can correctly perform the continuous slitting.

Finally, the inventors discovered an apparatus for manufacturing open carbon fiber superfine yarn that can continuously manufacture the open carbon fiber superfine yarn using the wet-type opening method.

In other words, they developed the world's first apparatus for manufacturing open carbon fiber superfine yarn that overcomes the traditional problems and can continuously manufacture the open carbon fiber superfine yarn using the wet-type opening method.

The present invention according to first aspect relates to an apparatus for manufacturing open carbon fiber superfine yarn, comprising: a yarn feeding part for feeding a carbon fiber bundle, a tank for storing water for opening carbon fiber to immerse the above-mentioned carbon fiber bundle in the above-mentioned water for opening carbon fiber, a first drying part for drying the open carbon fiber bundle formed by the immersion in the above-mentioned water for opening carbon fiber, an application part for applying a catalyst to the dried open carbon fiber bundle, a second drying part for drying the catalyst-applied open carbon fiber bundle to obtain open carbon fiber resin tape, a slitting part for slitting the above-mentioned open carbon fiber resin tape longitudinally, and a twisting part for twisting a plurality of the open carbon fiber resin tapes slit by the slitting part to form open carbon fiber superfine yarn.

The present invention according to second aspect relates to the apparatus for manufacturing open carbon fiber superfine yarn of the first aspect, wherein the above-mentioned water for opening carbon fiber is reduced water with an oxidation-reduction potential of −800 mV or less.

The present invention according to third aspect relates to the apparatus for manufacturing open carbon fiber superfine yarn of the first or second aspect, wherein the above-mentioned tank comprises one or more conveying rollers for carrying and conveying the above-mentioned carbon fiber bundle in the tank, and at least one of the above-mentioned conveying rollers has a swollen shape so that a rotation center portion is thicker than a peripheral part.

The present invention according to fourth aspect relates to the apparatus for manufacturing open carbon fiber superfine yarn of any one of the first to third aspect, wherein the above-mentioned first and second drying parts have rotatable heating rollers, and the rotatable heating rollers allow the above-mentioned open carbon fiber bundle in contact with an outer surface of the roller to travel on the outer surface in order to dry the open carbon fiber bundle.

The present invention according to fifth aspect relates to the apparatus for manufacturing open carbon fiber superfine yarn of any one of the first to fourth aspect, wherein the above-mentioned slitting part comprises a slit roll consisting of a blade fixing roll and a blade receiving roll, and the above-mentioned blade fixing roll comprises a pressing member for pressing one or more slitting blades and the above-mentioned open carbon fiber resin tape.

According to the present invention of the first aspect, an apparatus for manufacturing open carbon fiber superfine yarn comprises, a yarn feeding part for feeding a carbon fiber bundle, a tank for storing water for opening carbon fiber to immerse the above-mentioned carbon fiber bundle in the above-mentioned water for opening carbon fiber, a first drying part for drying an open carbon fiber bundle formed by the immersion in the above-mentioned water for opening carbon fiber, an application part for applying a catalyst to the dried open carbon fiber bundle, a second drying part for drying the catalyst-applied open carbon fiber bundle to obtain an open carbon fiber resin tape, a slitting part for slitting the above-mentioned open carbon fiber resin tape longitudinally, a twisting part for twisting a plurality of slit open carbon fiber resin tapes by the slitting part to form open carbon fiber superfine yarn.

Accordingly, the apparatus can serially manufacture open carbon fiber superfine yarn that can be continuously slit using a wet-type opening method.

Further, according to the present invention of the first aspect, the wet-type opening method enables manufacture of the open carbon fiber superfine yarn, and thus the superfine fiber waste with a very small diameter does not scatter in the air in the process of producing open carbon fiber.

In addition, the superfine fiber waste with a very small diameter does not scatter in the air in the process of producing the open carbon fiber superfine yarn. This can eliminate the necessity of isolating the space for producing the open carbon fiber and successfully simplify the production facility, while enabling correct, continuous, and prompt slitting.

Furthermore, the method can improve a manufacturing efficiency of open carbon fiber superfine yarn by about 15 times-about 20 times than a traditional method of manufacturing a carbon fiber superfine yarn (namely, a method of manufacturing open carbon fiber superfine yarn by baking carbon fiber bundle).

According to the present invention of the second aspect, the above-mentioned water for opening carbon fiber is reduced water with an oxidation-reduction potential of −800 mV or less, and thus it can easily spread the carbon fiber bundle flat.

According to the present invention of the third aspect, the above-mentioned tank comprises one or more conveying rollers for carrying and conveying the above-mentioned carbon fiber bundle in the tank, and at least one of the above-mentioned conveying rollers has a swollen shape so that a rotation center portion is thicker than a peripheral part. Accordingly, the roller can easily spread the carbon fiber bundle flat.

According to the present invention of the fourth aspect, the above-mentioned first and second drying parts have rotatable heating rollers, and the rotatable heating rollers allow the above-mentioned open carbon fiber bundle in contact with an outer surface of the roller to travel on the outer surface in order to dry the open carbon fiber bundle. Accordingly, the roller can evaporate water from the open carbon fiber bundle to easily dry the open carbon fiber bundle.

According to the present invention of the fifth aspect, the above-mentioned slitting part comprises a slit roll consisting of a blade fixing roll and a blade receiving roll, and the above-mentioned blade fixing roll comprises a pressing member for pressing one or more slitting blades and the above-mentioned open carbon fiber resin tape. Accordingly, the open carbon fiber resin tape can be easily and continuously slit at optional width.

BRIEF DESCRIPTION OF THE DRAWINGS

The present invention will be more fully understood and appreciated by reading the following Detailed Description in conjunction with the accompanying drawings, in which.

DETAILED DESCRIPTION OF EMBODIMENTS

Hereinafter, preferable embodiments of an apparatus for manufacturing open carbon fiber superfine yarn of the present invention will be set forth with reference to the attached drawings.

Figure 1:
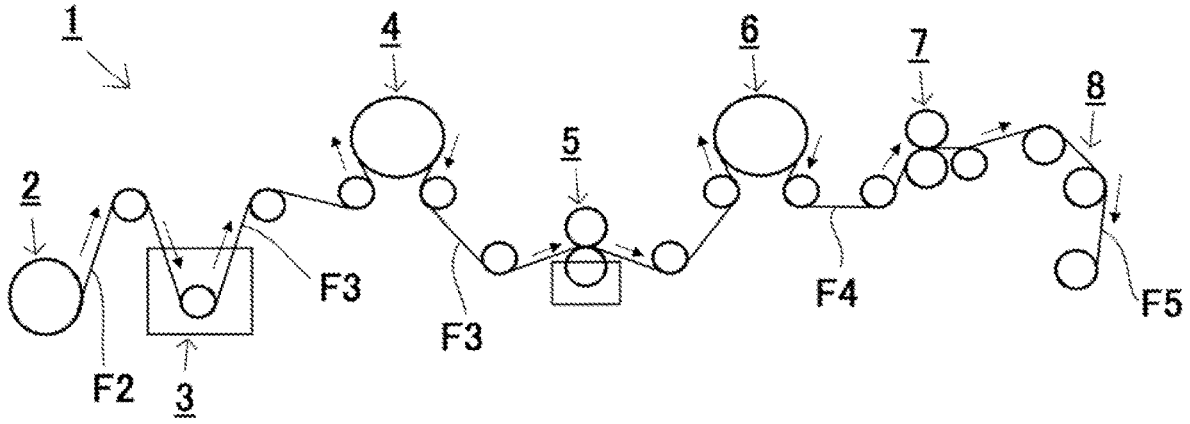
FIG. 1 is a schematic illustration of an apparatus for manufacturing open carbon fiber superfine yarn of the present invention.
Figure 2:
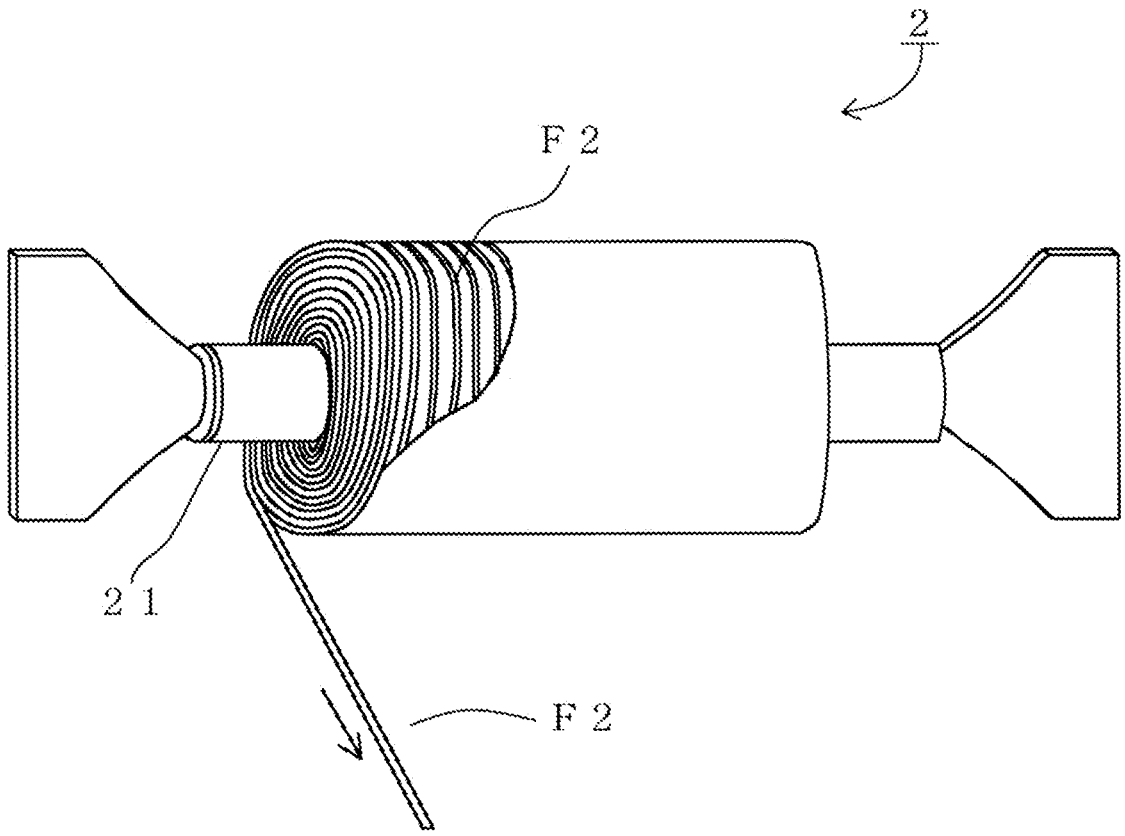
FIG. 2 is a schematic illustration of a yarn feeding part.
Figure 3:
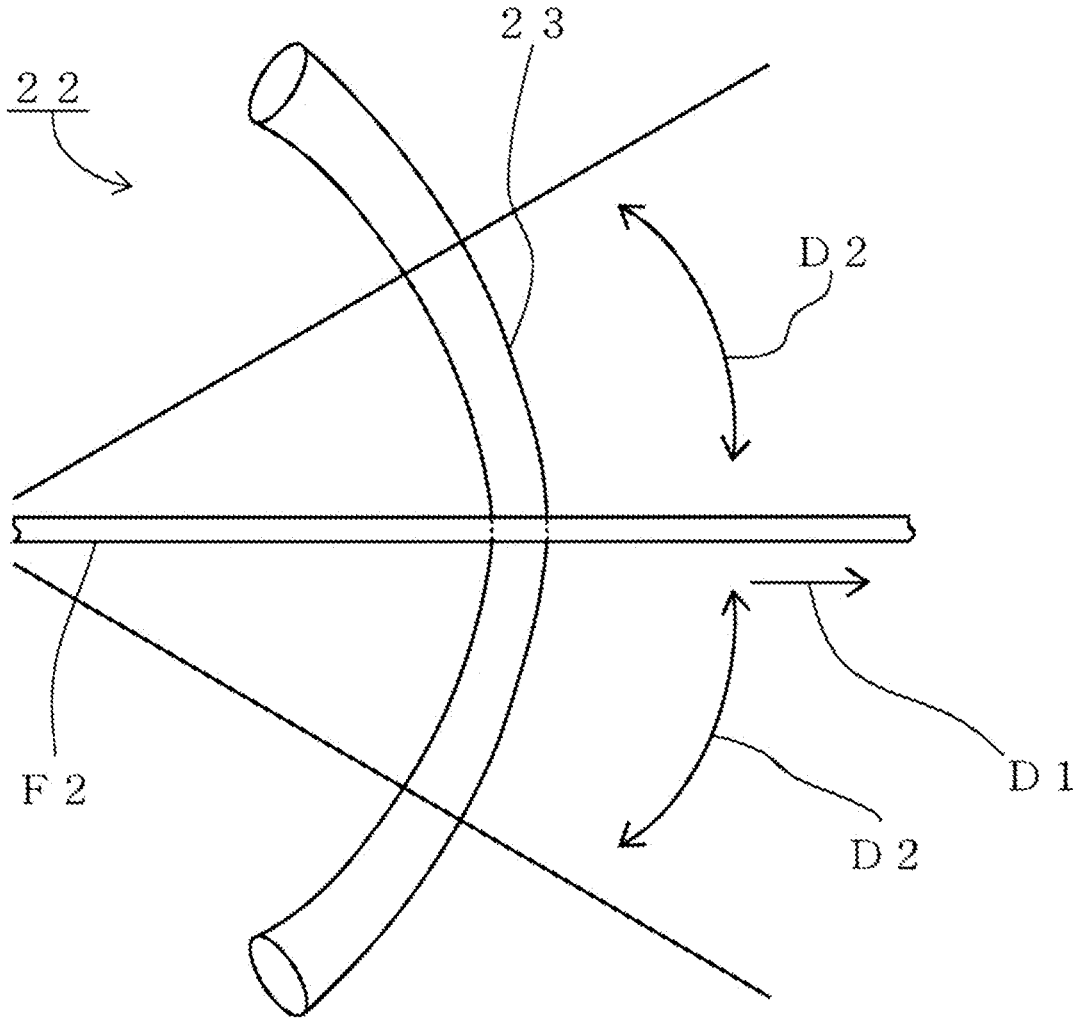
FIG. 3 is a schematic illustration of a mechanism for feeding a carbon fiber bundle in the yarn feeding part.
Figure 4:
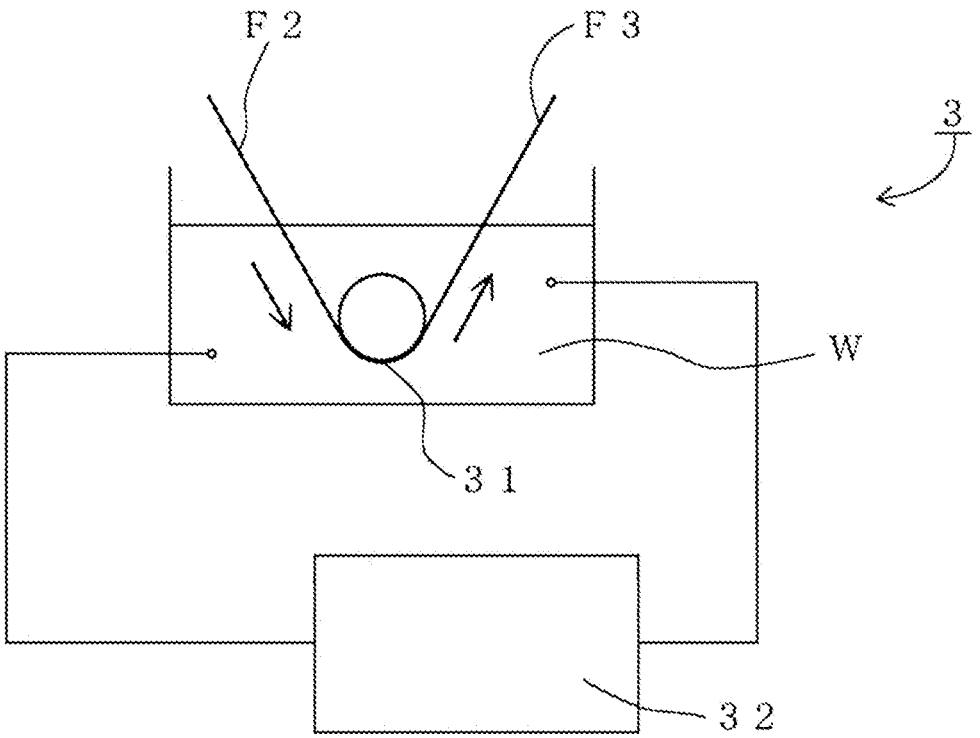
FIG. 4 is a schematic illustration of a tank.
Figure 5:
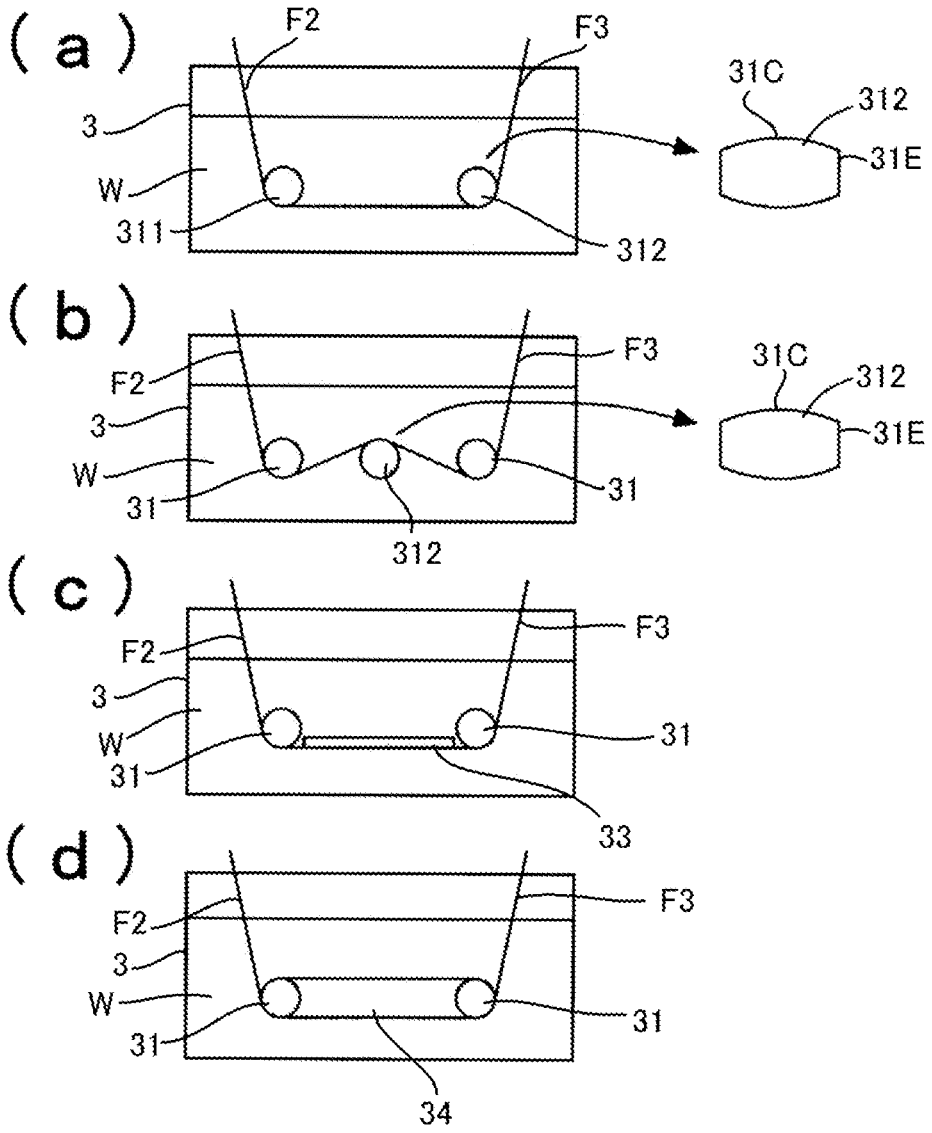
FIG. 5 is a schematic illustration of a mechanism for assisting opening action in the tank.
Figure 6:
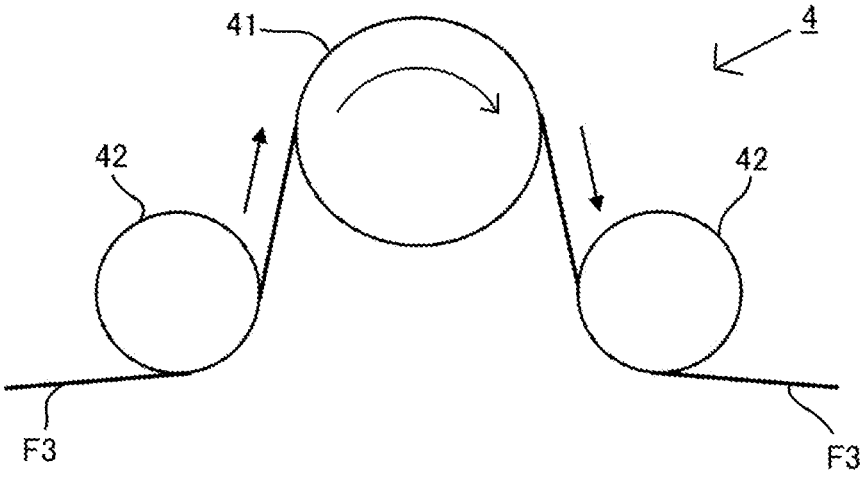
FIG. 6 is a schematic illustration of first and second drying parts.
Figure 7:
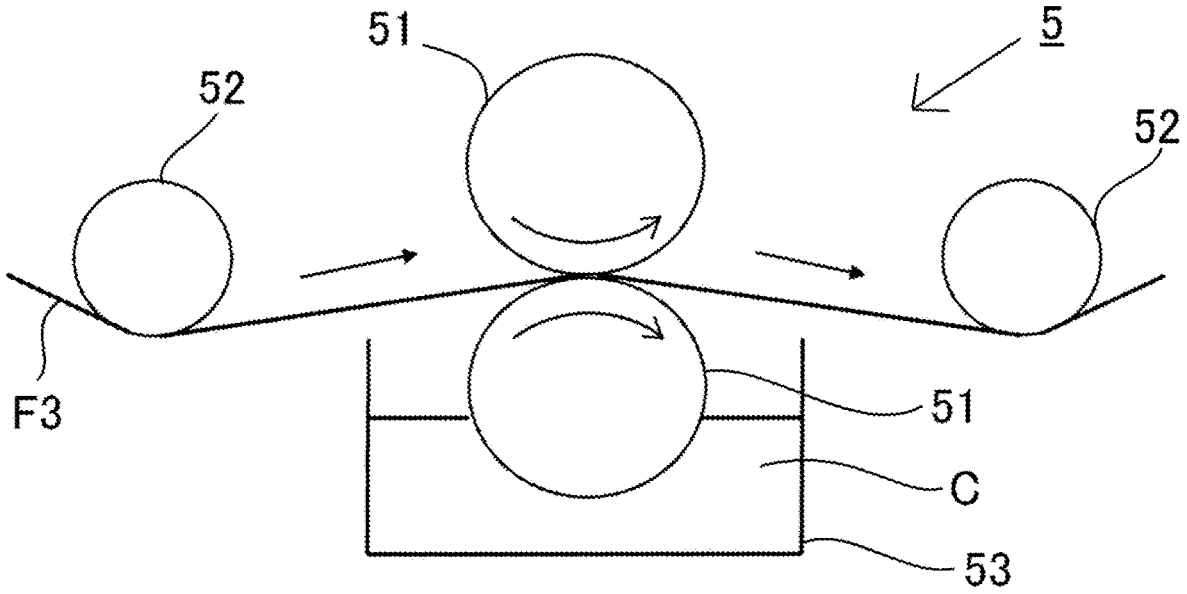
FIG. 7 is a schematic illustration of an application part.
Figure 8:
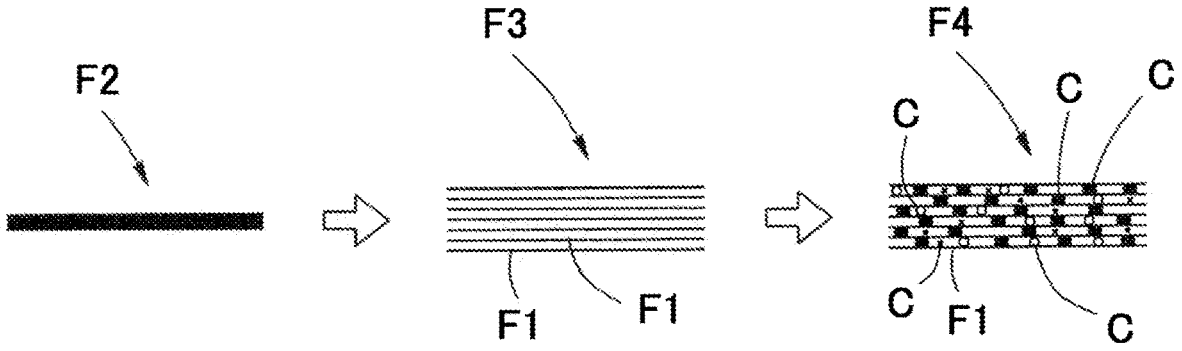
FIG. 8 is a schematic illustration of the forms of a carbon fiber bundle, an open carbon fiber bundle, and an open carbon fiber resin tape.
Figure 9:
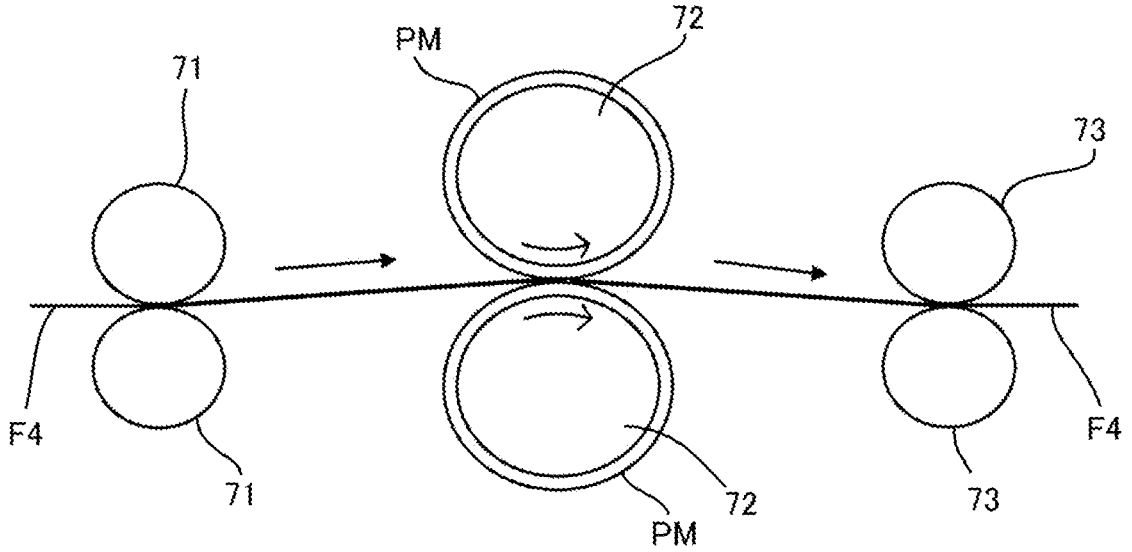
FIG. 9 is a schematic illustration of a slitting part.
Figure 10:
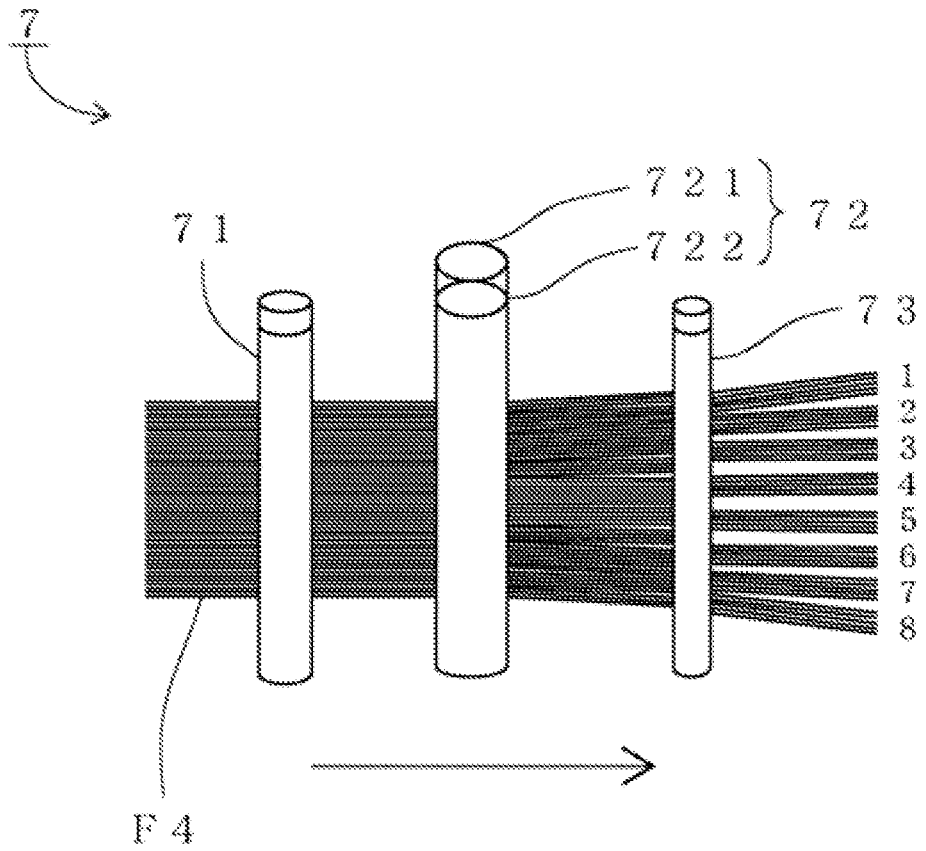
FIG. 10 is an illustration of the state of the open carbon fiber resin tape slit in the slitting part.
Figure 11:
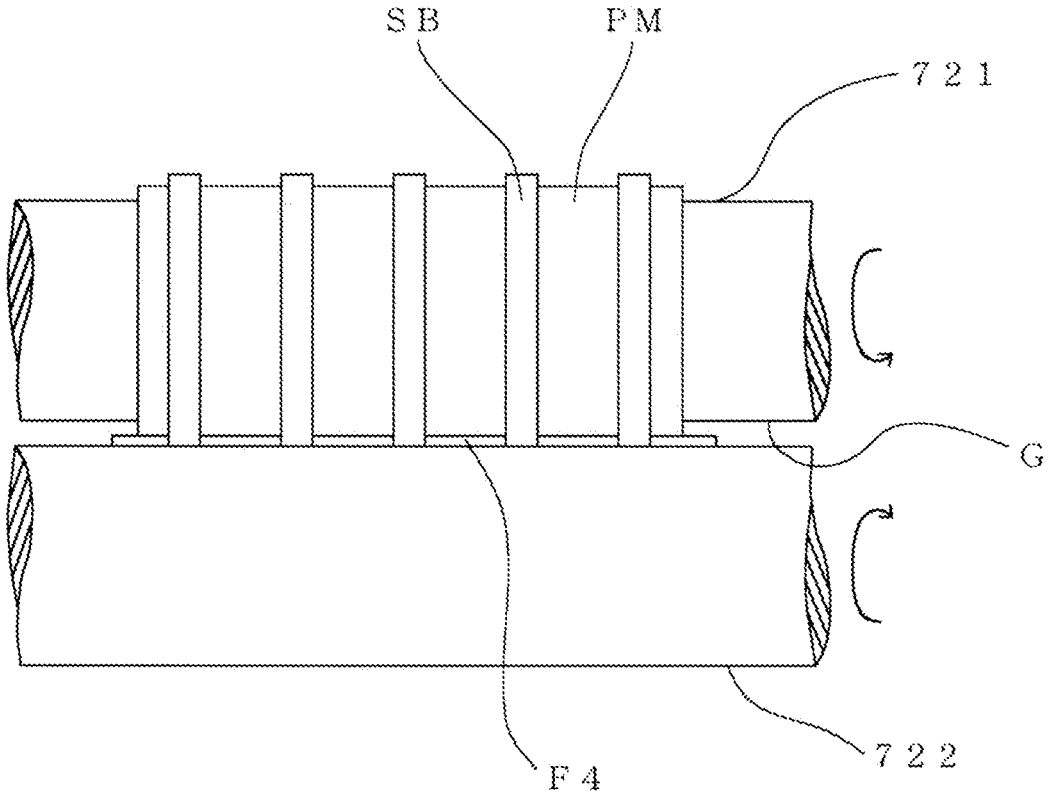
FIG. 11 is a part enlarged illustration of a slit roll in the slitting part.
Figure 12:
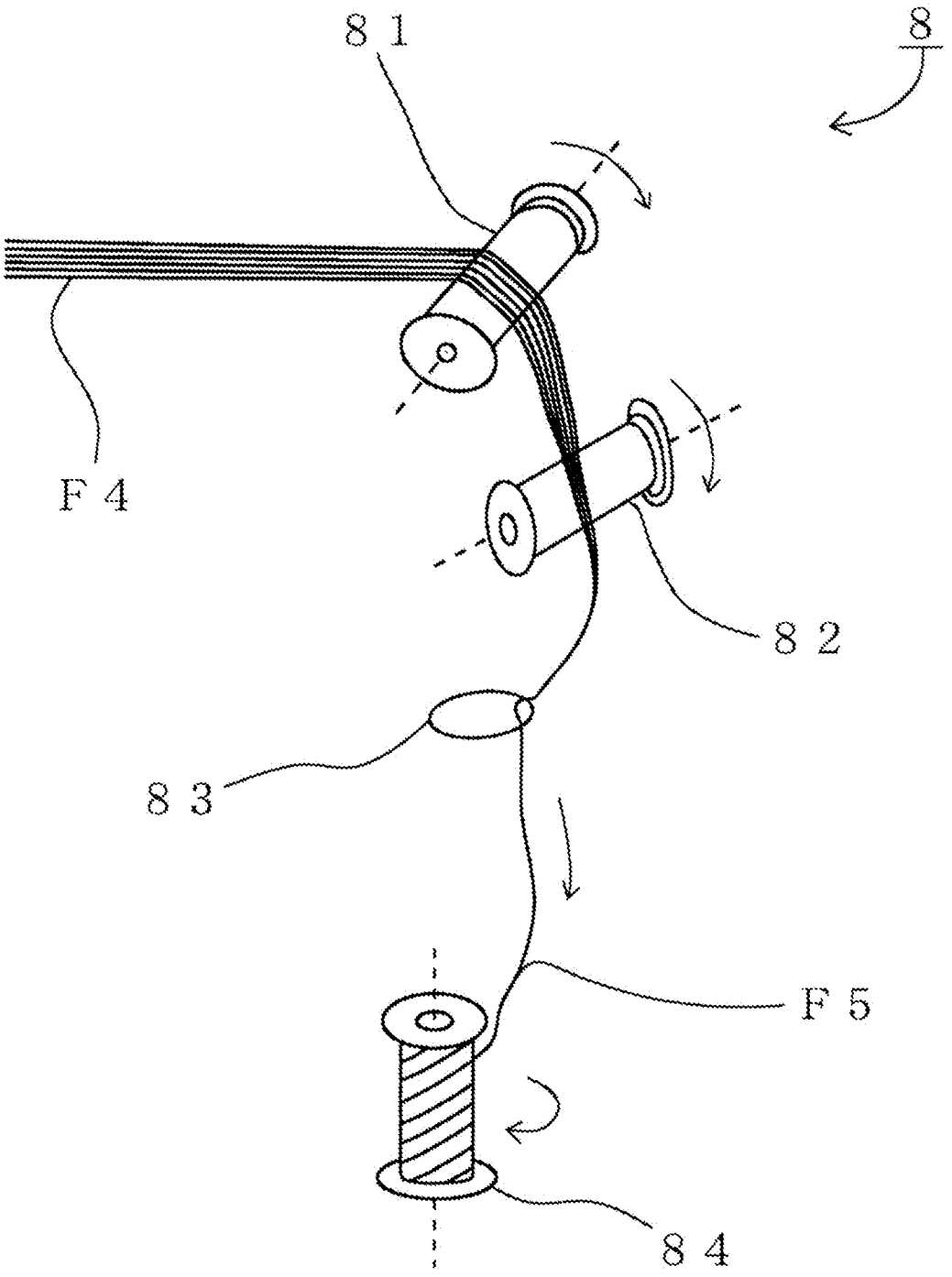
FIG. 12 is a schematic illustration of a twisting part.

FIG. 1 is a schematic illustration of an apparatus for manufacturing open carbon fiber superfine yarn of the present invention. FIG. 2 is a schematic illustration of a yarn feeding part. FIG. 3 is a schematic illustration of a mechanism for feeding a carbon fiber bundle in the yarn feeding part. FIG. 4 is a schematic illustration of a tank. FIG. 5 is a schematic illustration of a mechanism for assisting opening action in the tank. FIG. 6 is a schematic illustration of first and second drying parts. FIG. 7 is a schematic illustration of an application part. FIG. 8 is a schematic illustration of the forms of a carbon fiber bundle, an open carbon fiber bundle, and an open carbon fiber resin tape. FIG. 9 is a schematic illustration of a slitting part. FIG. 10 is an illustration of the state of the open carbon fiber resin tape slit in the slitting part. FIG. 11 is a part enlarged illustration of a slit roll in the slitting part. FIG. 12 is a schematic illustration of a twisting part.

As shown in FIG. 1, the apparatus (1) for manufacturing open carbon fiber superfine yarn of the present invention comprises: a yarn feeding part (2) for feeding a carbon fiber bundle (F2); a tank (3) for storing water for opening carbon fiber (W) to immerse the carbon fiber bundle (F2) in the water for opening carbon fiber (W); a first drying part (4) for drying an open carbon fiber bundle (F3) formed by the immersion in the water for opening carbon fiber (W); an application part (5) for applying a catalyst (C) to the dried open carbon fiber bundle (F3); a second drying part (6) for drying the catalyst (C)-applied opening carbon fiber bundle (F3) to obtain an open carbon fiber resin tape (F4); a slitting part (7) for slitting the open carbon fiber resin tape (F4) longitudinally; and a twisting part (8) for twisting the plurality of open carbon fiber resin tapes (F4) slit by the slitting part (7) to form an open carbon fiber superfine yarn (F5).

Arrows shown in FIG. 1 refer to directions in which a carbon fiber bundle (F2), an open carbon fiber bundle (F3), an open carbon fiber resin tape (F4), or an open carbon fiber superfine yarn (F5) is fed.

The apparatus (1) for manufacturing open carbon fiber superfine yarn of the present invention preferably comprises an operation board in which the operations of each part and whole apparatus can be performed collectively, although not shown in the figure.

As illustrated in FIG. 2, a yarn feeding part (2) has a roller-shape, and includes a carbon fiber bundle (F2) wound around a paper tube (21).

The yarn feeding part (2) is usually used to feed yarn such as carbon fiber, including any yarn feeding part obvious to a person skilled in the art.

In the present invention, from the point that a tension of carbon fiber bundle (F2) to be fed can be adjusted, it is desirable that the yarn feeding part (2) comprises a mechanism for adjusting the tension hydraulically or pneumatically.

An arrow shown in FIG. 2 refers to a direction in which the carbon fiber bundle (F2) is fed.

Raw yarn of the carbon fiber bundle (F2) used in the present invention can be used in any carbon fiber bundle. The raw yarn includes, but not limited to, a 3 K-24 K regular bundle (regular tow) of (i.e., 7 micrometers in diameter-.times.3000 to 7 micrometers in diameter.times.24000), a large bundle of more than 24 K (large tow) (i.e., more than 7 micrometers in diameter.times.24000 to 7 micrometers in diameter.times.64000), etc.

Both acrylic- and pitch-carbon fiber can be applied.

FIG. 3 is a schematic illustration of a mechanism (22) for feeding a carbon fiber bundle (F2) in the yarn feeding part (2).

The mechanism (22) is configured so that the carbon fiber bundle (F2) is fed from the yarn feeding part (2) while traveling in a horizontal direction (D2) with respect to a direction (D1) in which the bundle is fed.

Specifically, a contacting member (23) is provided so that it contacts with the bottom of the carbon fiber bundle (F2) fed from the yarn feeding part (2) using a tension generated hydraulically or pneumatically.

The contacting member (23) is desirably mirror-finished so that sliding resistance becomes very small.

The material of contacting member (23) desirably includes, but not limited to, e.g., SUS304 quenching material, etc., from the point that its sliding resistance is very small.

As illustrated in FIG. 4, a tank (3) stores water for opening carbon fiber (W).

The tank (3) comprises at least one or more conveying roller (31) and an apparatus for manufacturing water for opening carbon fiber (32) to manufacture and supply water for opening carbon fiber (W) inside.

The structure and material of the tank (3) include, but not limited to, any structure and material allowing a carbon fiber bundle (F2) to be immersed in water for opening carbon fiber (W) for a predetermined time.

Arrows shown in FIG. 4 refer to directions in which the carbon fiber bundle (F2) or open carbon fiber bundle (F3) is fed.

Water for opening carbon fiber (W) is reduced water with a negative oxidation-reduction potential.

Although normal water contains a positive oxidation-reduction potential (in the case of tap water: about +400 to +600 mV), the water for opening carbon fiber (W) has a negative oxidation-reduction potential, small water molecule cluster, and good penetrating force.

A carbon fiber bundle (F2) is immersed in such reduced water to be naturally spread without applying a physical external force such as ultrasonic wave, thereby providing an open carbon fiber bundle (F3).

However, applying a physical outside force is not completely excluded by the invention, and the method of the present invention may be combined with a conventional method for applying a physical outside force.

For example, it is also possible to adopt a method for installing an ultrasonic generator (not shown) in the tank (3) and applying ultrasonic waves to a carbon fiber bundle (F2) immersed in the water for opening carbon fiber (W).

In this case, sufficient opening is achieved by the opening action of the water for opening carbon fiber (W) even if the output of the ultrasonic waves is weakened, thereby providing an effect that the fully spread, belt-like open carbon fiber bundle (F3) can be manufactured efficiently while securely preventing damage to the fiber.

The water for opening carbon fiber (W) used in the present invention is preferably reduced water with an oxidation-reduction potential of −800 mV or less.

Using such reduced water with a low oxidation-reduction potential as water for opening carbon fiber (W), it becomes possible to securely spread a carbon fiber (F1) constituting the carbon fiber bundle (F2) flat in a short period of time in order to obtain a belt-like open carbon fiber bundle (F3).

Moreover, the obtained open carbon fiber bundle (F3) can maintain its open state easily and cannot return to its original state easily, compared with an open carbon fiber bundle obtained using normal water (namely, water with a positive oxidation-reduction potential).

The method for manufacturing reduced water used in the present invention includes, but not limited to, e.g., the following three methods.

1. Gas Bubbling Method

Bubbling nitrogen gas, argon gas or hydrogen gas reduces oxygen concentration and oxidation-reduction potential in water.

2. Method with the Addition of Hydrazine

Adding hydrazine reduces oxygen concentration and oxidation-reduction potential in water.

3. Method with Electrolysis (a) Electrolysis of water is performed by applying a high frequency voltage having asymmetric positive and negative wave crest value and/or duty ratio, thereby reducing an oxidation-reduction potential.

(b) An electrode is made of one ground electrode (cathode), and two special shaped electrodes (rhombus shaped net-like electrode or hexagonal shaped net-like electrode) consisting of Pt and Ti in which an anode and cathode change alternately, and electrolysis of water is performed by applying a high frequency voltage, thereby reducing an oxidation-reduction potential.

Especially, in the present invention, it is preferable to use the reduced water obtained by the "3 (b)" method of the three above-mentioned methods.

This is because the reduced water which has low oxidation-reduction potential (−800 mV or less) and can keep oxidation-reduction potential negative over a long period of time is easily and certainly obtained by using the "3(b)" method, compared with the other methods.

Further, the applicant discloses an apparatus for performing the "3(b)" method in Japanese Patent No. 4607296, and thus the method can be provided based on the disclosure.

Accordingly, any apparatus which can manufacture the reduced water having no more than −800 of oxidation-reduction potential can be used as an apparatus for manufacturing the reduced water for opening carbon fiber (32), but it is preferable to use the apparatus for manufacturing water disclosed in Japanese Patent No. 4607296.

Since a carbon fiber bundle (F2) is carbonized (no less than 99.8% of carbonization rate), it is an inorganic material and has a negative charge (−potential).

The carbon fiber bundle (F2) having a negative charge is immersed into the reduced water having the negative charge, so that the negative charge in the reduced water and the negative charge in the carbon fiber bundle (F2) repel each other, and thus carbon fibers in the carbon fiber bundle (F2) separate.

The carbon fiber bundle (F2) in this state is continuously applied tension and pulled to form an open carbon fiber bundle (F3).

The principle of forming this open carbon fiber bundle (F3) is disclosed in Japanese Patent No. 4607296.

In the present invention, although the carbon fiber bundle (F2) can be automatically spread (opened) by immersing it into the reduced water having the negative charge as described above without applying physical external force, a configuration as shown in FIG. 5 (*a*)-(*d*) may be adopted to help this opening action.

FIG. 5(*a*) shows an embodiment in which two conveying rollers (31), which support and convey the carbon fiber bundle (F2), are provided in the tank (3).

In this embodiment, the second conveying roller (312) of the two conveying rollers (311, 312) has an opening action.

Specifically, the cross-sectional shape (a cross section along with the rotation axis) of the second conveying roller (312) has a bulge so that the thickness of the rotation center portion (31C) is larger than that of the peripheral part (31E), as indicated with an arrow drawn in the figure, and thus, the carbon fiber bundle (F2) is easy to spread along the surface of the conveying roller (31).

FIG. 5(*b*) shows an embodiment in which 3 or more conveying rollers (31) (in this figure, 3 conveying rollers), which support and convey the carbon fiber bundle (F2), are provided in the tank (3).

This embodiment is configured to bend and convey the carbon fiber bundle (F2) by providing 3 or more conveying rollers (31) (in this figure, 3 conveying rollers), allowing the second and following conveying rollers (in the figure, the second roller (312)) to have an opening action.

Specifically, the conveying roller (31) has a similar cross-sectional shape with FIG. 5 (*a*) so that the carbon fiber bundle (F2) is easy to spread along the surface of the conveying roller (31).

FIG. 5(*c*) shows an embodiment in which a plate (33) is provided between one or more conveying roller (31), which support and convey the carbon fiber bundle (F2) in the tank (3).

The carbon fiber bundle (F2) is conveyed along the surface of this plate (33) so that the carbon fiber bundle (F2) is easy to spread more flat.

FIG. 5(*d*) shows an embodiment in which a flat belt (34) is wound around one or more conveying roller (31), which support and convey the carbon fiber bundle (F2) in the tank (3).

The carbon fiber bundle (F2) is conveyed along the surface of this flat belt (33) so that the carbon fiber bundle (F2) is easy to spread more flat.

As shown in FIG. 6, the first drying part (4) comprises a rotatable heating roller (41) and one or more guide rollers (42).

The first drying part (4) is provided to dry an open carbon fiber bundle (F3) which is formed by immersing in water for opening carbon fiber (W).

The first drying part (4) can dry the open carbon fiber bundle (F3) by contacting the open carbon fiber bundle (F3) on the outer surface of the heating roller (41) and running the open carbon fiber bundle (F3) on the outer surface of the heating roller (41).

It is preferable to use the contact type drier (for example, rotary drum type drier) which can momentarily evaporate moisture of the open carbon fiber bundle (F3) formed by immersing in the water for opening carbon fiber (W) for the first drying part (4).

The carbon fiber bundle (F3) can be kept open over a long period of time by momentarily evaporating moisture of the open carbon fiber bundle (F3).

The arrow in FIG. 6 shows a direction in which the open carbon fiber bundle (F3) is fed.

It is possible to use any drier which can momentarily evaporate moisture of the open carbon fiber bundle (F3) formed by immersing in the water for opening carbon fiber (W), without limiting to the above-mentioned contact type drier for the first drying part (4).

The guide roller (42) is only for moving the open carbon fiber bundle (F3) smoothly, and thus the guide roller may not be provided.

As shown in FIG. 7, the application part (5) comprises a catalyst tank (53) for storing a catalyst (C), a pair of application rollers (51), and one or more guide rollers (52).

The application part (5) is provided to apply the catalyst (C) on the open carbon fiber bundle (F3) dried in the first drying part (4).

In the state where tension (tensile strength) is applied, the open carbon fiber bundle (F3) is kept open and does not return to its original state. On the other hand, in the state where tension is not applied, there is a possibility that the open state is easily released and the open carbon fiber bundle returns to its original state, that about 7.mu.m of fiber wastes is generated, or the like.

Therefore, there is a possibility that manufacture of the open carbon fiber superfine yarn becomes difficult or the fiber wastes have an adverse effect on environment.

In order to resolve these problems, the present invention apply the catalyst (C) on the dried open carbon fiber bundle (F3), and thus aims to prevent fluff and/or fiber wastes from being generated and to uniformize dimensions such as the thickness and/or width of the open carbon fiber bundle (F3).

As shown in FIG. 7, a part of at least one application roller from the pair of the application roller (51) at the application part (5) is soaked in the catalyst (C) stored by the catalyst tank (53).

Therefore, the pair of application rollers (51) rotates, and the open carbon fiber bundle (F3) passing between the pair of application rollers (51) can be uniformly applied the catalyst (C).

The catalyst (C) may be applied to both of the pair of application rollers (51).

The application part (5) is not limited to the above-mentioned configuration, and for example, it may be configured to immerse the open carbon fiber bundle (F3) directly into the catalyst (C), and it is possible to use any configuration in which a catalyst (C) can be applied to the open carbon fiber bundle (F3).

The guide roller (52) is only for moving the open carbon fiber bundle (F3) smoothly, and thus the guide roller may not be provided.

The structure and/or material of the catalyst tank (53) is not specifically limited, and it is possible to use any structure and/or material which can pool the catalyst (C).

An arrow in FIG. 7 shows a direction in which the open carbon fiber bundle (F3) is fed.

The catalyst (C) applied on the open carbon fiber bundle (F3) is not limited and used as sizing agents including any synthetic resin such as epoxy resin or an adhesive or a sizing agent for carbon fibers, and it is possible to use any agent which is obvious for those skilled in the art.

In addition, it is preferable to use a catalyst containing an adhesive, metal oxide sol, and potassium persulfate (or benzoyl) as a catalyst (C) from points of view of prevention of generation of the fluff and the fiber wastes and uniformization of dimensions such as the thickness and/or width of the open carbon fiber bundle (F3).

When the catalyst containing the adhesive, the metal oxide sol, and potassium persulfate (or benzoyl) is used as a catalyst (C), the adhesive has a hydrophilic group, and a water-soluble starch such as a laundry starch, PVA (polyvinyl alcohol), a PTFE (polytetrafluoroethylene) dispersion, a graphite nano dispersion, glycol, a water-soluble clay dispersion, a starch paste, an organic or inorganic material-containing dispersion solution having an OH-group is suitably used as an adhesive.

If concentration of the adhesive is lower than the predetermined range, the open carbon fiber bundle (F3) may possibly return to its original state. If concentration of the adhesive is higher than the predetermined range, the adhesive may possibly become difficult to penetrate into the carbon fiber bundle (F2).

When the adhesive is polyvinyl alcohol (PVA) resin (simply referred to as PVA), it preferably has 0.5-30 wt % of concentration.

The concentration of metal oxide sol is preferably 0.5-16.7 wt %. If concentration of metal oxide sol is lower than the above-described lower limit, the adhesive strength of the below-mentioned carbon fiber resin tape (F4) may possibly decrease. Even if concentration of metal oxide sol is higher than the above-described upper limit, the adhesive strength of the open carbon fiber resin tape (F4) is less likely to increase.

Concentration ratio of PVA to metal oxide sol is preferably 3:1. Concentration of potassium persulfate is preferably 0.5-10 wt %.

The metal oxide sol included in the adhesive solution is one or more kinds of metal oxide sols selected from a group consisting of aluminum oxide (alumina), tin oxide, titanium oxide, tantalum oxide, niobium oxide, and zirconium oxide.

These metal oxide sols contain many OH groups. When the metal oxide sol containing many OH groups is used for the adhesive solution, the number of OH groups contained in adhesive solution increases and the chemical bond strength (adhesive strength) by OH groups increases, and thus, it is possible to easily glue and bond rubber products in the range of 60.degree. C. and 180.degree. C., and carbon fibers, other organic and inorganic substances in the range of 60.degree. C. and 265.degree. C. In addition, a high mechanical strength and peel intensity can be given to the open carbon fiber resin tape (F4).

The metal oxide sol used for the adhesive solution is not limited to the above-mentioned metal oxide sol, it is possible to use any metal oxide sol which contains many OH groups, such as lanthanum oxide, neodymium oxide, and cerium oxide.

Moreover, a particle size and/or pH of a metal oxide sol is not specifically limited, and any particle size and pH of metal oxide sol which can be used for the adhesive solution are acceptable.

An alumina shape of alumina sol may be any of a plate-like, columnar, fibrous, hexagonal plate-like shapes, and so on.

Also, an alumina fiber where alumina sol is in fibrous shape is a fibrous crystal of alumina, and specifically, it includes an alumina fiber formed with an anhydrate of alumina, an alumina hydrate fiber formed with a hydrate-containing alumina, etc.

A crystal system of the alumina fiber may include any of an amorphous, boehmite, and pseudo-boehmite crystal systems, etc. Boehmite is a crystal of the alumina hydrate represented by a compositional formula: Al2O3.nH2O. The crystal system of the alumina fiber can be adjusted according to, for example, a class of a hydrolyzable aluminum compound, its hydrolysis condition, or peptization condition, any of which will be described later. The crystal system of the alumina fiber can be identified using an X-ray diffractometer (for example, a product name "Mac. Sci. MXP-18", MAC Science Co., Ltd.).

In addition, a shape of the metal oxide contained in the metal oxide sol other than alumina sol may be, but not particularly limited to, any shape such as plate-like, columnar, fibrous, hexagonal plate-like shapes, and the like.

Moreover, if the metal oxide sol other than alumina sol is in fibrous shape, the metal oxide is a fibrous crystal thereof. More specifically, the fibrous crystal includes a metal oxide fiber formed with an anhydrate of the metal oxide, a metal oxide hydrate fiber formed with a hydrate-containing metal oxide, or the like.

A metal oxide sol used for an adhesives solution (a metal oxide sol, such as alumina, tin oxide, titanium oxide, tantalum oxide, niobium oxide, or zirconium oxide) includes, but not limited to: for example, alumina sol-10A (wt. % in terms of Al2O3: 9.8-10.2, particle size (nm): 5-15, viscosity mPa/s (25.degree. C.): <50, pH: 3.4-4.2, manufactured by Kawaken Fine Chemicals Co., Ltd.), alumina sol-A2 (wt. % in terms of Al2O3: 9.8-10.2, particle size (nm): 10-20, viscosity mPa/s (25.degree. C.): <200, pH: 3.4-4.2, manufactured by Kawaken Fine Chemicals Co., Ltd.), alumina sol-CSA-110AD (wt. % in terms of Al2O3: 6.0-6.4, particle size (nm): 5-15, viscosity mPa/s (25.degree. C.): <50, pH: 3.8-4.5, manufactured by Kawaken Fine Chemicals Co., Ltd.), alumina sol-F1000 (wt. % in terms of Al2O3: 4.8-5.2, particle size (nm): 1400, viscosity mPa/s (25.degree. C.): <1000, pH: 2.9-3.3, manufactured by Kawaken Fine Chemicals Co., Ltd.), alumina sol-F3000 (wt. % in terms of Al2O3: 4.8-5.2, particle size (nm): 2000-4500, viscosity mPa/s (25.degree. C.): <1000, pH: 2.7-3.3, manufactured by Kawaken Fine Chemicals Co., Ltd.), Tainoc A-6 (wt. % in terms of TiO2: 6, mean particle size: 20 nm, pH: 12, manufactured by Taki Chemical Co., Ltd.), Tainoc AM-15 (wt. % in terms of TiO2: 15, average particle size: 20 nm, pH: 4, manufactured by Taki Chemical Co., Ltd.), Biral Zr—C20 (wt. % in terms of ZrO2: 20, average particle size: 40 nm, pH: 8, manufactured by Taki Chemical Co., Ltd.), Biral La—C10 (wt. % in terms of La2O3: 10, average particle size: 40 nm, pH: 8, manufactured by Taki Chemical Co., Ltd.), Biral Nd—C10 (wt. % in terms of Nd2O3: 10, average particle size: 20 nm, pH: 9, manufactured by Taki Chemical Co., Ltd.), Needlal B-10 (wt. % in terms of CeO2: 10, average particle size: 20 nm, pH: 8, manufactured by Taki Chemical Co., Ltd.), Ceramace S-8 (wt. % in terms of SnO2: 8, average particle size: 8 nm, pH: 10, manufactured by Taki Chemical Co., Ltd.), Biral Nb-G6000 (wt. % in terms of Nb2O3: 6, average particle size: 15 nm, pH: 8, manufactured by Taki Chemical Co., Ltd.), or the like, and may be a metal oxide sol containing a large number of OH-groups, such as tin oxide, titanium oxide, tantalum oxide, niobium oxide, or zirconium oxide, and any metal oxide sol known to those skilled in the art can be used.

It is preferable to use a PVA resin which is a thermoplastic resin as an adhesion component (adhesive) for an adhesive solution.

The PVA resin has a structural formula shown below and contains many OH-groups. Therefore, it is characterized by having very strong hydrophilicity and being soluble in warm water, and thus it can glue/bond rubber products in the range of 60.degree. C. to 180.degree. C. and carbon fibers, etc. in the range of 60.degree. C. to 265.degree. C.

Moreover, since the PVA resin is a thermoplastic resin, it is softened by once gluing/bonding carbon fibers, etc., followed by reheating or rewarming of the glued/bonded carbon fibers, etc., allowing for easy peeling of the glued/bonded carbon fibers, etc.

In addition, the PVA resin stably exists in the adhesive even after blended into the adhesive solution and thus its adhesive/bonding strength is less likely to decline. As such, the adhesive solution containing the PVA resin can be stably used for a long period of time.

Using the PVA resin which is a thermoplastic resin and contains OH-groups for an adhesive solution eliminates the need for conventionally heating the carbon fibers, etc. at high temperature, in gluing/bonding, allowing for easy gluing/bonding of rubber products, carbon fibers, and the other organic or inorganic substances, and also for easy peeling of the once glued substances as they are not physically glued/bonded (i.e., not fitted according to structures or shapes of the gluing substances and the glued objects nor glued/bonded by thermal stress, etc.).

[Formula 1]

As such, the open carbon fiber bundle (F3) is immersed in a catalyst (C) as illustrated above, and thus the catalyst (C) permeates between the spread carbon fiber (F1) and the carbon fiber (F1).

The open carbon fiber bundle (F3), where the catalyst (C) was applied in the application part (5), is dried in the second drying part (6).

The second drying part (6) has the same structure as the above-mentioned first drying part (4) (see FIG. 6).

Any catalyst (C) is applied in the application part (5) and impregnated in the open carbon fiber bundle (F3), and the open carbon fiber bundle (F3) is dried in the second drying part (6), to produce an open carbon fiber resin tape (F4).

FIG. 8 is a schematic illustration showing forms of a carbon fiber bundle (F2), an open carbon fiber bundle (F3), and an open carbon fiber resin tape (F4).

The carbon fiber bundle (F2) consisting of a plurality of carbon fibers (F1) becomes an open carbon fiber bundle (F3) where the carbon fibers (F1) spread flat by being immersed in water for opening carbon fiber (W), and a catalyst (C) permeates between the carbon fibers (F1) by being applied to this open carbon fiber bundle (F3), to form an open carbon fiber resin tape (F4).

As such, by hardening the open carbon fiber bundle (F3) with the catalyst (C) while the carbon fibers spread flat, the open state is kept unreleased and the open carbon fiber bundle will not return to its original state even with the lapse of time, and also an open carbon fiber resin tape (F4) with high mechanical strength can be obtained.

As shown in FIG. 9, the slitting part (7) comprises a feeding tensioner (71), a slit roll (72), and a winding-up tensioner (73).

The slitting part (7) is provided to longitudinally (i.e., in a feeding direction) slit (cut) the open carbon fiber resin tape (F4) so as to make any width and numbers of the open carbon fiber resin tape (F4).

Besides, the arrow shown in FIG. 9 refers to a feeding direction of the open carbon fiber resin tape (F4).

For example, as shown in FIG. 10, in the slit roll (72), a single open carbon fiber resin tape (F4) can be slit into eight open carbon fiber resin tapes (1-8 in FIG. 10).

The slit open carbon fiber resin tapes are fed to the twisting part (8) while they are given tension by the winding-up tensioner (73).

Besides, the arrow shown in FIG. 10 refers to a feeding direction of the open carbon fiber resin tape (F4).

As shown in FIG. 11, the slit roll (72) is provided with a blade fixing roll (721) and a blade receiving roll (722).

The blade fixing roll (721) is provided with one or more slitting blades (SB) for slitting an open carbon fiber resin tape (F4) and a pressing member (PM) for pressing down an open carbon fiber resin tape (F4).

The blade fixing roll (721) is provided with one or more slitting blades (SB) on its outer surface, and thus the open carbon fiber resin tape (F4) can be slit into any width and numbers.

Besides, the arrow shown in FIG. 11 refers to a direction of rotation of the blade fixing roll (721) and the blade receiving roll (722).

Any number of one or more slit blades (SB) are provided on the outside surface of the blade fixing roll (721) over the width of the blade fixing roll (721).

The shape of the slit blade (SB) is not limited, but is preferably a round blade because it can cut the open carbon fiber resin tape (F4) easily, achieve the clean cut face, and be usable for a long time.

Preferably, the shape of the edge of the slit blade (SB) is suitably selected from, for example, a single-edge type, an edge type, a rectangle type, and the like without limitation according to the purpose of use.

Preferably, the shape of the edge of the slit blade (SB) is suitably selected in consideration of the rotation speed of feeding the open carbon fiber resin tape (F4) (for example, rotating 60 to 80 times).

Moreover, the material of the slit blade (SB) is not limited, but is preferably an ultrahard hastelloy, SIC, and the like, because it can cut the open carbon fiber resin tape (F4) easily, achieve the clean cut face, and be usable for a long time.

A pressing member (PM) is provided on the outside surface of a blade fixing roll (721) on which no slit blade (SB) is provided.

As shown in FIG. 11, in the part having the pressing member (PM), a gap (G) between the blade fixing roll (721) and a blade receiving roll (722) is narrower than the gap (G) in the part having no pressing member (PM).

A material of the pressing member (PM) is preferably a rubber, such as urethane rubber, EPDM, SB, NBR, and the like.

Rubber hardness of the pressing member (PM) is preferably from 65 to 75 degrees, and more preferably 70 degrees, so as to slit the open carbon fiber resin tape (F4) more easily and more accurately.

In addition, while the thickness of the pressing member (PM) is suitably determined according to the slit width of the open carbon fiber resin tape (F4), it is preferably from 1.0 to 15.0 mm, and more preferably from 3 to 5 mm, so as to slit the open carbon fiber resin tape (F4) more easily and more accurately.

When slitting the open carbon fiber resin tape (F4), there is a possibility that the open carbon fiber resin tape (F4) is too thin to be cut well.

As a result of providing the pressing member (PM) on the outside surface of the blade fixing roll (721) having no slit blade (SB), it is possible to slit continuously the open carbon fiber resin tape (F4) using a repulsive force of a rubber while pressing the open carbon fiber resin tape (F4) by the pressing member (PM).

The inventors' ardent effort enabled the best configuration for slitting this open carbon fiber resin tape (F4).

The most important step is the one of slitting the open carbon fiber resin tape (F4) uniformly into an optional width to finish open carbon fiber superfine yarn (F5) with high quality, as described below.

Therefore, the below three requirements are necessary for a slitting part (7) in order to uniformly slit the open carbon fiber resin tape (F4) into an optional width.

1. Accuracy of the slit width (i.e., the tolerance is (−) 0.01 mm to 0.015 mm (+) 0.01 to 0.15 mm/25 mm.times.m).

2. No variation in the weight between each slit open carbon fiber resin tapes (F4) (i.e., 0.01 g/m/25 mm.times.m).

3. No splits nor scuffing on the slit face.

In order to meet the three requirements, a feeding tensioner (71) and a winding-up tensioner (73) are important elements.

The mechanism of these tensioners is preferably an electromagnetic torque clutch or a hydraulic clutch so as to stably generate a constant tension.

The mechanism of the tensioners is more preferably a hydraulic clutch because of its easy fine adjustment.

As shown in FIG. 12, the twisting part (8) comprises a first roll (81), a second roll (82), a fixing ring (83), and a winding-up roll (84).

A plurality of open carbon fiber resin tapes (F4) slit into an optional width by the slitting part (7) are fed from the winding-up tensioner (73) into the twisting part (8), and twisted optional times while passing through the first roll (81), the second roll (82), and the fixing ring (83) which stick-slips the slit open carbon fiber resin tapes (F4), thereby manufacturing open carbon fiber superfine yarn (F5).

The manufactured open carbon fiber superfine yarn (F5) is wound up by the winding-up roll (84) having a motor.

The configuration of the twisting part (8) is not limited and can be any twister, if it is usually used for production of twisted yarn such as a fiber and is obvious to a person skilled in the art.

The arrows shown in FIG. 12 represent the direction to which the open carbon fiber resin tape (F4) or the open carbon fiber superfine yarn (F5) is to be fed.

The twist number per meter of the open carbon fiber superfine yarn (F5) is not limited, but is preferably determined to be, for example 30 to 80 times/m, according to its use.

The appropriate twist number is 65 times/m, though it changes properly according to the slit width of the open carbon fiber resin tape (F4) and the type of open carbon fiber superfine yarn (F5).

This twist number can be optionally adjusted with the rotation speed of the twisting part (8), according to the requirement for knitted goods, textiles, sewing threads for codes, composite materials, Z twist, S twist, ropes, and so on.

INDUSTRIAL APPLICABILITY

The apparatus for manufacturing open carbon fiber superfine yarn according to the invention comprises a feeding part for feeding a carbon fiber bundle, a tank for storing water for opening carbon fiber to immerse the carbon fiber bundle in the water, a first drying part for drying an open carbon fiber bundle formed after the immersion in the water for opening carbon fiber, an application part for applying a catalyst to the dried open carbon fiber bundle, a second drying part for drying the catalyst-applied open carbon fiber bundle to obtain an open carbon fiber resin tape, a slitting part for slitting the open carbon fiber resin tape longitudinally, and a twisting part for twisting a plurality of the open carbon fiber resin tapes slit by the slitting part to form open carbon fiber superfine yarn. Accordingly, it can continuously slit by a wet type opening method to serially manufacture the open carbon fiber superfine yarn.

Furthermore, because the open carbon fiber superfine yarn can be manufactured by a wet type opening method, there is no risk of scattering superfine fiber wastes with very small diameter in the air during the process of manufacturing the open carbon fiber.

In addition, because there is no risk of scattering superfine fiber wastes with very small diameter in the air during the process of manufacturing the open carbon fiber, there is no need to isolate the space for manufacturing the open carbon fiber, thereby enabling simplification of the production facility and even an accurate and continuous slit with high speed.

Moreover, it is possible to enhance the production efficiency of open carbon fiber superfine yarn about 15 times to about 20 times more than the conventional production method of manufacturing carbon fiber superfine yarn (i.e., a method of manufacturing carbon fiber superfine yarn by baking a carbon fiber bundle).

EXPLANATION OF NUMERALS

1 Apparatus for manufacturing open carbon fiber superfine yarn
2 Yarn feeding Part
3 Tank
4 First drying part
5 Application Part
6 Second drying part
7 Slitting part
8 Twisting part
F1 Carbon fiber
F2 Carbon fiber bundle
F3 Open carbon fiber bundle F4 Open carbon fiber resin tape F5 Open carbon fiber superfine yarn C Catalyst W Water for opening carbon fiber

What is claimed is:

1. An apparatus for manufacturing open carbon fiber superfine yarn, comprising:

a yarn feeding part for feeding a carbon fiber bundle, a tank for storing water for opening carbon fiber to immerse the carbon fiber bundle in the water for opening carbon fiber, a first drying part for drying the open carbon fiber bundle formed by the immersion in the water for opening carbon fiber, an application part for applying a catalyst to the dried open carbon fiber bundle, a second drying part for drying the catalyst-applied open carbon fiber bundle to obtain an open carbon fiber resin tape (F4), a slitting part (7) for slitting the open carbon fiber resin tape (F4) longitudinally, and a twisting part (8) for twisting a plurality of the open carbon fiber resin tapes (F4) obtained by the second drying part in order to form an open carbon fiber superfine yarn, said open fiber resin tapes (F4) being slit by the slitting part (8), wherein said slitting part (7) is provided to longitudinally slit the open carbon fiber resin tape (F4), wherein said slitting part (7) comprises a feeding tensioner (71), a slit roll (72), and a winding-up tensioner (73), wherein slit open carbon fiber resin tapes which are slit by said slitting part (8) are fed to the twisting part (8) while said slit open carbon fiber resin tapes are given tension by said winding-up tensioner (73).

2. The apparatus for manufacturing open carbon fiber superfine yarn according to claim 1, wherein the slitting part comprises said slit roll consisting of a blade fixing roll and a blade receiving roll, and the blade fixing roll comprises a pressing member for pressing one or more slitting blades and the open carbon fiber resin tape.

* * * * *